US008266898B2

(12) United States Patent
Fujiwara et al.

(10) Patent No.: US 8,266,898 B2
(45) Date of Patent: Sep. 18, 2012

(54) CONTROL APPARATUS FOR INTERNAL COMBUSTION ENGINE

(75) Inventors: Takahiko Fujiwara, Susono (JP); Noriyasu Kobashi, Suntou-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 235 days.

(21) Appl. No.: 12/674,833

(22) PCT Filed: Sep. 18, 2008

(86) PCT No.: PCT/JP2008/067364

§ 371 (c)(1),
(2), (4) Date: Mar. 12, 2010

(87) PCT Pub. No.: WO2009/038221

PCT Pub. Date: Mar. 26, 2009

(65) Prior Publication Data

US 2010/0205942 A1 Aug. 19, 2010

(30) Foreign Application Priority Data

Sep. 20, 2007 (JP) ..... 2007-243624

(51) Int. Cl.
*F01N 3/02* (2006.01)
*F01N 3/35* (2006.01)
*F02D 41/14* (2006.01)

(52) U.S. Cl. ..... 60/295; 60/285; 60/297; 60/277

(58) Field of Classification Search ..... 60/277, 60/285, 297

See application file for complete search history.

(56) References Cited

U.S. PATENT DOCUMENTS

| | | | | |
|---|---|---|---|---|
| 5,644,912 | A * | 7/1997 | Kawamura | 60/276 |
| 6,438,943 | B1 * | 8/2002 | Yamamoto et al. | 60/274 |
| 6,479,023 | B1 * | 11/2002 | Evans et al. | 422/186.04 |
| 2003/0131593 | A1 * | 7/2003 | Asanuma | 60/297 |
| 2004/0050036 | A1 | 3/2004 | Ueda et al. | |
| 2004/0123589 | A1 * | 7/2004 | Ohtake et al. | 60/295 |
| 2005/0016162 | A1 | 1/2005 | Mehta et al. | |
| 2007/0199305 | A1 | 8/2007 | Hoshi | |

FOREIGN PATENT DOCUMENTS

EP 0 890 724 A2 1/1999

(Continued)

OTHER PUBLICATIONS

International Search Report for International Application No. PCT/JP2008/067364, mailed Feb. 13, 2009.

(Continued)

*Primary Examiner* — Kenneth Bomberg
*Assistant Examiner* — Brandon Lee
(74) *Attorney, Agent, or Firm* — Oliff & Berridge, PLC

(57) ABSTRACT

An internal combustion engine is provided that performs stoichiometric burn operation under control for providing a stoichiometric air-fuel ratio as basic control for an air-fuel ratio. A particulate filter (PM filter) is provided in an exhaust passage of the engine to trap particulate matter PM contained in exhaust gas. If it is judged that the PM filter will have excessively elevated temperature, fuel cut is prohibited during deceleration. Otherwise, before the prohibition of the fuel cut, the air-fuel ratio of exhaust gas is controlled so that the atmosphere of the PM filter is brought into an atmosphere slightly leaner than the stoichiometric air-fuel ratio.

2 Claims, 2 Drawing Sheets

FOREIGN PATENT DOCUMENTS

| | | | |
|---|---|---|---|
| EP | 1 077 078 | A2 | 2/2001 |
| EP | 1 176 298 | A2 | 1/2002 |
| EP | 1 479 895 | A2 | 11/2004 |
| EP | 1 619 098 | A2 | 1/2006 |
| JP | U-64-3017 | | 1/1989 |
| JP | A-8-326524 | | 12/1996 |
| JP | 2002-38943 | A | 2/2002 |
| JP | 2002-188491 | A | 7/2002 |
| JP | A-2003-129835 | | 5/2003 |
| JP | A-2003-206732 | | 7/2003 |
| JP | A-2005-201210 | | 7/2005 |

OTHER PUBLICATIONS

Jul. 31, 2012 Office Action issued in Japanese Patent Application No. 2011-034625.

* cited by examiner

CONTROL APPARATUS FOR INTERNAL COMBUSTION ENGINE

TECHNICAL FIELD

The present invention relates generally to control apparatuses for an internal combustion engine, and more specifically, to a control apparatus suitable to control an internal combustion engine equipped in an exhaust passage with a particulate filter for trapping particulate matter PM.

BACKGROUND ART

For example, Patent Document 1 discloses an exhaust emission purifying system for a diesel engine equipped in an exhaust passage with a particulate filter (hereinafter referred to as "the PM filter") for trapping particulate matter PM. This conventional system is designed to reduce the opening angle of an intake throttle valve and increase the opening angle of an EGR valve only when a judgment is made that the PM filter will not have excessively elevated temperature if the engine, during regeneration of the PM filter, comes into a deceleration operation state where fuel supply is stopped (fuel cut).

By exercising the above-mentioned control the conventional system suppresses lowering of and an excessive rise of the PM filter temperature if a diesel engine operation state comes into a deceleration operation state during regeneration of the PM filter. In this way, the conventional system attempts to satisfactorily continue the regeneration of the PM filter.

Including the above-mentioned document, the applicant is aware of the following document as a related art of the present invention.

[Patent Document 1] Japanese Laid-open Patent Application Publication No. 2005-201210

[Patent Document 2] Japanese Laid-open Patent Application Publication No. Hei 8-326524

[Patent Document 3] Japanese Laid-open Patent Application Publication No. 2003-129835

[Patent Document 4] Japanese Laid-open Utility Model Application Publication No. Sho 64-3017

DISCLOSURE OF INVENTION

Problem to be Solved by the Invention

The above-mentioned conventional control is temperature control of the gas flowing into the PM filter assuming an internal combustion engine that performs lean burn operation, such as a diesel engine. In other words, this conventional control does not assume an internal combustion engine that exercises, as basic control, air-fuel ratio control to provide a stoichiometric air-fuel ratio. That is to say, the conventional control does not assume an internal combustion engine that performs stoichiometric burn operation, such as a gasoline engine.

The present invention has been made to solve the above-mentioned problem and it is an object of the invention to provide a control apparatus for an internal combustion engine, such as a stoichiometric engine equipped with a PM filer in an exhaust passage, that can satisfactorily prevent occurrence of excessively elevated temperature of the PM filter to thereby facilitate continuous regeneration of particulate matter PM trapped by the PM filter without an adverse effect.

Means for Solving Problems

The above object is achieved by a control apparatus for an internal combustion engine that is provided in an exhaust passage with a particulate filter for trapping particulate matter contained in exhaust gas, and that performs stoichiometric burn operation under control for providing a stoichiometric air-fuel ratio as basic control for an air-fuel ratio. A filter OT judgment means is provided for judging whether or not the particulate filter will have an excessively elevated temperature. A control means is also provided for exercising control so that atmosphere of the particulate filter may become an atmosphere leaner than a stoichiometric air-fuel ratio, if it is judged that the particulate filter will have an excessively elevated temperature.

In a second aspect of the present invention, the control means may control a burning rate of the particulate matter trapped by the particulate filter based on a leanness degree of the atmosphere of the particulate filter.

The above object is achieved by a control apparatus for an internal combustion engine that is provided in an exhaust passage with a particulate filter for trapping particulate matter contained in exhaust gas, and that performs stoichiometric burn operation under control for providing a stoichiometric air-fuel ratio as basic control for an air-fuel ratio. A fuel cut control means is provided for performing fuel cut during deceleration of the internal combustion engine. A filter OT judgment means is also provided for judging whether or not the particulate filter will have an excessively elevated temperature due to performance of the fuel cut. A fuel cut prohibition means is further provided for prohibiting performance of fuel cut during deceleration, if it is judged that the particulate filter will have an excessively elevated temperature.

The fourth aspect of the present invention may include an air-fuel ratio control means for controlling an air-fuel ratio of exhaust gas discharged from the internal combustion engine. If the filter OT judgment means judges that the particulate filter will have an excessively elevated temperature, the air-fuel ratio control means may exercise slight-lean control on the air-fuel ratio of the exhaust gas so that an atmosphere of the particulate filter may become an atmosphere slightly leaner than the stoichiometric air-fuel ratio, before the fuel cut prohibition means prohibits fuel cut during deceleration.

In a fifth aspect of the present invention, after the slight-lean control has been started, the air-fuel ratio control means continuously may exercise the slight-lean control until the filter OT judgment means judges that the particulate filter will not have an excessively elevated temperature.

In a sixth aspect of the present invention, the filter OT judgment means may include OT degree judgment means for judging an assumed degree of excessively elevated temperature of the particulate filter. An air-fuel ratio control means may be further provided for exercising slight-lean control on an air-fuel ratio of exhaust gas so that an atmosphere of the particulate filter may become an atmosphere slightly leaner than a stoichiometric air-fuel ratio. A filter OT avoidance control selecting means may be further provided for selecting prohibition of fuel cut during deceleration by the fuel cut prohibition means if the filter OT judgment means judges that the degree of excessively elevated temperature of the particulate filter is relatively high, and for selecting performance of the slight-lean control by the air-fuel ratio control means if the filter OT judgment means judges that the degree of excessively elevated temperature of the particulate filter is relatively low.

A seventh aspect of the present invention may further include a catalyst disposed in the exhaust passage and being capable of purifying the exhaust gas. An upstream side air-fuel ratio sensor may be further disposed in the exhaust passage upstream of the catalyst to obtain information on an air-fuel ratio of the exhaust gas discharged from a cylinder. A downstream side air-fuel ratio sensor may be further disposed in the exhaust passage downstream of the catalyst to obtain information on an air-fuel ratio of the exhaust gas discharged downstream of the catalyst. The particulate filter may be further disposed in the exhaust passage upstream of the downstream side air-fuel ratio sensor. The air-fuel ratio control means, when exercising the slight-lean control, may control the atmosphere of the particulate filter into the slight-lean atmosphere on the basis of an output of the downstream side air-fuel ratio sensor.

Effects of the Invention

According to the first aspect of the invention, if it is judged that the excessively elevated temperature of the particulate filter is a concern, the atmosphere of the filter is controlled into the lean atmosphere. For the internal combustion engine performing the stoichiometric burn operation, the atmosphere of the particulate filter tends to have high temperature compared with a lean burn engine such as a diesel engine. For this reason, the internal combustion engine performing the stoichiometric burn operation brings the atmosphere of the particulate filter into the lean atmosphere, thereby burning and removing the particulate matter PM accumulating on the particulate filter. According to the present invention, the system provided with the internal combustion engine basically performing the stoichiometric burn operation can maintain the amount of particulate matter PM accumulating on the particulate filter at such a level as not to worry about the excessively elevated temperature of the particulate filter. This can satisfactorily prevent the occurrence of the excessively elevated temperature of the particulate filter (and thus melting of the filter). Thus, it becomes possible to facilitate the continuous regeneration of the particulate matter PM trapped by the particulate filter without an adverse effect.

As the amount of oxygen fed to the particulate filter trapping particulate matter PM is increased, the burning rate of the particulate matter PM (the regeneration rate of the particulate filter) is faster. Consequently, the burning temperature of the particulate matter PM is elevated. According to the second aspect of the invention, the burning rate of the particulate matter PM is controlled based on the leanness degree of the atmosphere of the particulate filter. This can burn and remove the particulate matter PM in a range where the burning temperature of the particulate matter PM trapped does not reach abnormally high temperature.

According to the third aspect of the invention, it is possible to suppress a rapid increase in the amount of oxygen fed to the particulate filter on which particulate matter PM sufficiently accumulate and which has high temperature. Because of this, the internal combustion engine performing the stoichiometric burn operation can prevent the particulate filter from having abnormally high temperature resulting from the performance of the fuel cut. Thus, the particulate filter can satisfactorily be prevented from being melted.

According to the fourth aspect of the invention, if it is judged that the excessively elevated temperature of the particulate filter is a concern, the slight-lean control is exercised prior to the prohibition of fuel cut. That is to say, according to the present invention, in the early stage where it is started to worry about the excessively elevated temperature of the particulate filter, the slight-lean control rapidly burns and removes the particulate matter PM. Thus, the present invention can achieve a preferable balance between the prevention of excessively elevated temperature of the particulate filter (and thus melting of the filter) and an improvement in fuel consumption resulting from ensuring time for performing the fuel cut. The occurrence of the excessively elevated temperature of the particulate filter (and thus the melting of the particulate filter) can satisfactorily be prevented as described above. Therefore, the system provided with the internal combustion engine basically performing the stoichiometric burn operation can facilitate the continuous regeneration of the particulate matter PM trapped by the particulate filter without an adverse effect.

According to the fifth aspect of the invention, it is possible to prevent the progress of accumulation of particulate matter PM on the particulate filter to such a level that there is concern that melting of the particulate filter occurs due to abnormally high temperature resulting from the performance of fuel cut.

According to the sixth invention, any one of the prohibition of fuel cut and the performance of the slight-lean control is selected according to the assumed degree of the excessively elevated temperature of the particulate filter. Therefore, the present invention can achieve a preferable balance between the prevention of excessively elevated temperature of the particulate filter (and thus melting of the filter) and an improvement in fuel consumption resulting from ensuring time for performing the fuel cut. The occurrence of the excessively elevated temperature of the particulate filter (and thus the melting of the particulate filter) can satisfactorily be prevented as described above. Therefore, the system provided with the internal combustion engine basically performing the stoichiometric burn operation can facilitate the continuous regeneration of the particulate matter PM trapped by the particulate filter without an adverse effect.

According to the seventh aspect of the invention, the downstream side air-fuel ratio sensor disposed in the exhaust passage downstream of the catalyst to obtain information on the air-fuel ratio of the exhaust gas discharged downstream of the catalyst is used to accurately control the oxygen concentration of the exhaust gas passing through the particulate filter. Thus, the slight-lean control can accurately be exercised while the deterioration in the NOx-purification capacity remains minimized.

BEST MODE FOR CARRYING OUT THE INVENTION

First Embodiment

Description of System Configuration

Figure 1:
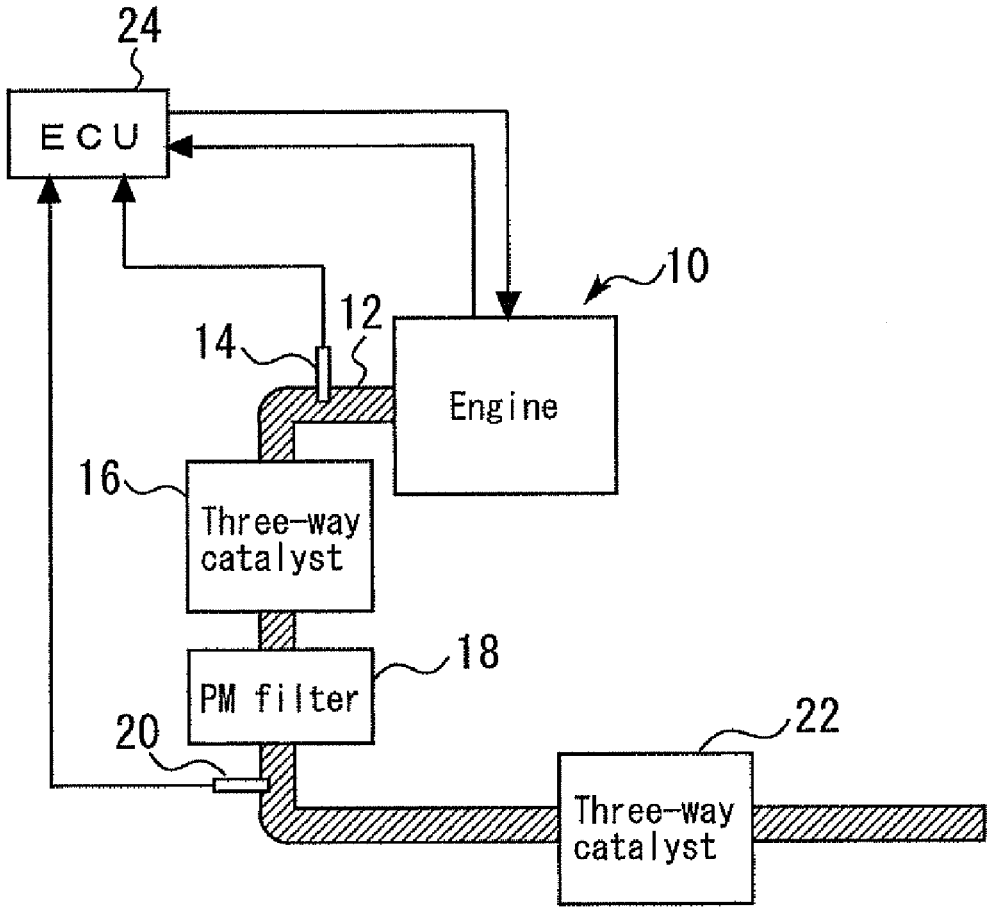
FIG. 1 is a schematic diagram for assistance in explaining an internal combustion engine system according to a first embodiment of the present invention.

FIG. 1 is a schematic diagram for assistance in explaining an internal combustion engine system according to a first embodiment of the present invention. The system shown in FIG. 1 includes an internal combustion engine 10. This engine 10 is a stoichiometric burn engine which exercises, as basic control, air-fuel ratio control to provide a stoichiometric air-fuel ratio for combustion. Here, the internal combustion engine 10 is a gasoline engine that performs such stoichiometric burn operation, by way of example.

The internal combustion engine 10 is provided with an exhaust passage 12. A main linear A/F sensor (hereinafter simply abbreviated as "the A/F sensor") 14 is disposed in the exhaust passage 12 to detect an air-fuel ratio of exhaust gas discharged from the inside of a cylinder. The A/F sensor 14 is a sensor that issues an output generally linear with respect to the air-fuel ratio of the exhaust gas.

An upstream side three-way catalyst 16 capable of purifying ternary components (NOx, HC, CO) contained in the exhaust gas is disposed in the exhaust passage 12 downstream of the A/F sensor 14. A particulate filter (hereinafter referred to as "the PM filter") 18 capable of trapping and removing particulate matter PM contained in the exhaust gas is disposed in the exhaust passage 12 downstream of the upstream side three-way catalyst 16.

A sub O2 sensor 20 is disposed in the exhaust passage 12 downstream of the PM filter 18 to make a signal in response to whether an air-fuel ratio at that position is rich or lean. Further, a downstream side three-way catalyst 22 capable of purifying the above-mentioned ternary components contained in the exhaust gas is disposed in the exhaust passage 12 downstream of the sub O2 sensor 20. Incidentally, the air-fuel ratio sensor disposed upstream of the upstream side three-way catalyst 16 may be an oxygen sensor having the same configuration as the sub O2 sensor 20 instead of the main linear A/F sensor 14 mentioned above.

The system shown in FIG. 1 includes an ECU (Electronic Control Unit) 24. Various sensors (not shown) as well as the A/F sensor 14 and sub O2 sensor 20 mentioned above are connected to the ECU 24 to measure various information (engine cooling water temperature, an amount of intake air, engine speed, a throttle angle, an accelerator angle, etc.) for controlling the internal combustion engine 10. In addition, various actuators not shown such as a throttle valve, a fuel injection valve, an ignition plug, etc. are connected to the ECU 24.

Air-Fuel Ratio Feedback Control

The internal combustion engine 10 of the present embodiment is an internal combustion engine that performs stoichiometric burn operation under, as basic control, air-fuel ratio control to provide a stoichiometric air-fuel ratio as described above. More specifically, the present embodiment exercises air-fuel ratio feedback control described below using the outputs of the A/F sensor 14 and of the sub O2 sensor 20 to control the air fuel ratio into a value close to the stoichiometric air-fuel ratio. That is to say, the system of the present embodiment exercises the main feedback control based on the output of the upstream side A/F sensor 14, and exercises the sub feedback control based on the output of the downstream side sub O2 sensor 20. In the main feedback control, an amount of fuel injection is controlled to allow the air fuel ratio of the exhaust gas flowing into the upstream side three-way catalyst 16 to agree with the control target air fuel ratio. In the sub feedback control, the contents of the main feedback control is corrected so that the air-fuel ratio of the exhaust gas flowing out downstream of the upstream side three-way catalyst 16 may become a stoichiometric air-fuel ratio.

PM Trapping by the PM Filter and Regeneration

The PM filter 18 shown in FIG. 1 traps PM contained in exhaust gas to suppress the PM discharged into the atmosphere. In order to continuously trap PM, the system equipped with such a PM filter 18 needs regeneration in which the trapped PM is removed to regenerate the trapping capability of the PM filter 18. Examples of such PM regeneration conceivably include processing in which the PM filter 18 is put under a high-temperature and lean atmosphere to burn and remove the trapped PM. More specifically, the system provided with the stoichiometric burn engine according to the embodiment performs, as such steady regeneration of the PM filter 18, continuous regeneration of the PM filter 18 by providing a configuration of supplying oxygen from the outside to the PM filter 18.

A Characteristic Part of the First Embodiment

A Problem Specific to the Stoichiometric Burn Engine Resulting from the Regeneration of the PM Filter Incidentally, like the internal combustion engine 10 of the present embodiment, the stoichiometric burn engine which performs combustion in a state where an air-fuel ratio is controlled into a stoichiometric air-fuel ratio tends to increase combustion temperature compared with a lean burn engine which performs lean combustion operation such as a diesel engine. Consequently, the stoichiometric burn engine tends to increase the atmospheric temperature of the PM filter 18 compared with the lean burn engine. On the other hand, for the stoichiometric burn engine, the atmosphere of the PM filter 18 is basically a stoichiometric atmosphere. Therefore, it is difficult for the atmosphere of the PM filter 18 to ensure a sufficient amount of oxygen, compared with the lean burn engine.

The stoichiometric burn engine as described above may execute fuel cut upon receipt of a deceleration request during the operation of the internal combustion engine 10. In such a case, concentration of oxygen in the atmosphere of the PM filter 18 in the stoichiometric atmosphere rapidly rises. On this occasion, if the PM filter 18 is in a high-temperature state, a large amount of oxygen is rapidly supplied to the PM filter 18 to burn the PM accumulating on the PM filter 18 at a burst.

During the PM burning, as an amount of oxygen inputted to the PM which is fuel is increased, an oxidation reaction rate (i.e., the burning rate of the PM) is increased. The temperature-elevation degree of the PM filter 18 along with the burning of the PM is more increased as the amount of the PM accumulated on the PM filter 18 is larger or as the reaction rate (the burning rate of the PM) is higher.

In the circumstances where the amount of PM accumulating on the PM filter 18 is large and the temperature of the PM filter 18 is high, fuel cut may be executed upon receipt of a deceleration request. In such a case, the PM filter 18 is rapidly increased in temperature. As a result, if the PM filter 18 is excessively increased in temperature in excess of its upper limit, there is concern that the PM filter 18 is melted.

Outline of the Characteristic Control of the First Embodiment

To eliminate such a concern, the present embodiment exercises the following control. The amount of PM accumulating on the PM filter 18 is relatively large and the temperature of the PM filter is relatively high. Because of this, a judgment may be made that the PM filter 18 is on the first stage where there is concern that the PM filter 18 will have excessively elevated temperature. In such a case, the air-fuel ratio of the exhaust gas is subjected to slight-lean control so that the atmosphere of the PM filter 18 may be slightly lean, i.e., leaner than the stoichiometric air-fuel ratio. In addition, during the slight-lean control, the burning rate of the accumulating PM (i.e., the regeneration rate of the PM) is controlled by adjusting the leanness degree of the atmosphere of the PM filter 18 using the output of the sub O2 sensor 20 so that the PM filter 18 may not have abnormally high temperature in excess of filter upper limit temperature due to burning of the accumulating PM.

Further in the present embodiment, the amount of PM accumulating on the PM filter 18 is sufficiently large and the temperature of the PM filter 18 is sufficiently high. Because of this, if fuel cut is performed during deceleration, a judgment may be made that the PM filter 18 is on the second stage where the PM filter 18 will have abnormally high temperature in excess of the filter upper limit temperature mentioned above. In such a case, it is prohibited to perform fuel cut during deceleration.

Specific Processing in the First Embodiment

Figure 2:
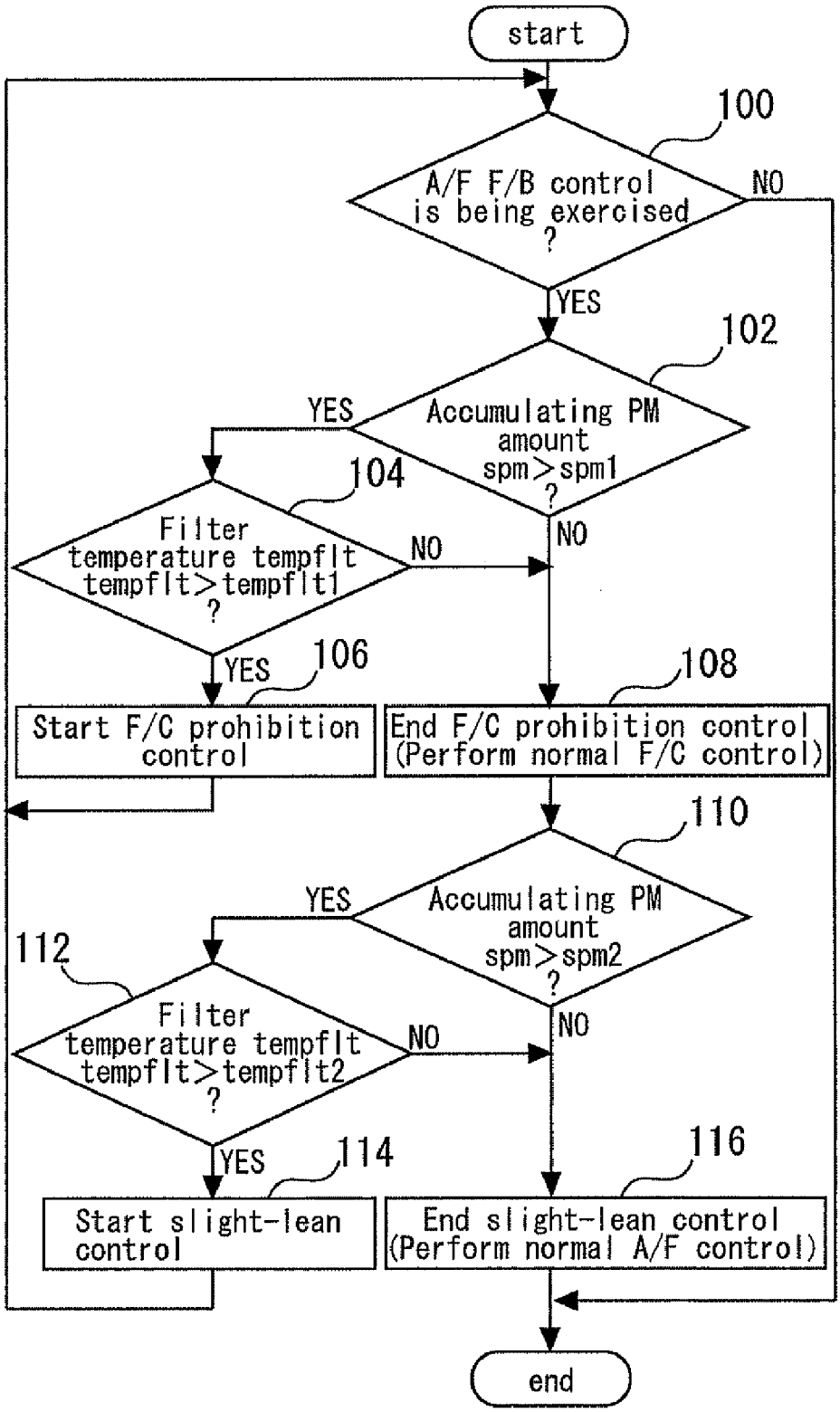
FIG. 2 is a flowchart representing a routine that is executed in the first embodiment of the present invention.

FIG. 2 is a flowchart representing a routine performed by the ECU 24 to actualize the functions described above.

In the routine shown in FIG. 2, it is first, judged whether or not the above-mentioned feedback control of the air-fuel ratio (A/F) is being exercised for the stoichiometric operation performed by the internal combustion engine 10 (step 100).

If it is judged that the feedback control is being exercised, it is judged whether or not the amount "spm" of PM accumulating on the PM filter 18 is equal to or more than a predetermined value "spm1" (step 102). This predetermined value "spm1" is a threshold value used to judge whether or not the amount "spm" of PM accumulating on the PM filter 18 is such an accumulating amount that there is concern that the PM filter 18 will have abnormally high temperature (OT (Over Temperature)) in excess of the filter upper limit temperature if the fuel cut is performed during deceleration.

In step 102 described above, the PM accumulating amount "spm" is judged based on the operation record (cooling water temperature, an air-fuel ratio, and an intake air amount) of the internal combustion engine 10, the temperature of the PM filter 18, and the oxygen concentration record of the atmosphere of the PM filter 18. Incidentally, the temperature of the PM filter 18 can be estimated based on the operating conditions (engine speed, load factor or the like) of the internal combustion engine 10. The oxygen concentration record of the atmosphere of the PM filter 18 can be obtained based on the output of the sub O2 sensor 20 disposed downstream of the PM filter 18.

In step 102 described above, if it is judged that the filter accumulating PM amount "spm" is greater than the predetermined value "spm1", it is judged whether or not the temperature "tempflt" of the PM filter 18 is equal to or more than the predetermined value "tempflt1" (step 104). This predetermined value "tempflt1" is a threshold value used to judge whether or not the temperature "tempflt" of the PM filter 18 is such temperature as to cause melting of the PM filter 18 if the fuel cut is performed during deceleration.

Judgment may be made that the filter temperature "tempflt" is greater than the predetermined value "tempflt1" in step 104. That is to say, affirmative judgment may be made in both steps 102 and 104. In such a case, it may be judged that melting of the PM filter 18 is a concern if fuel cut is performed in the current conditions of the PM filter 18. In other words, the PM filter 18 may be in the above-mentioned second stage. In this case, F/C prohibition control is started to prohibit the performance of the fuel cut (F/C) during deceleration (step 106).

On the other hand, if negative judgment is made in step 102 or 104, the F/C prohibition control is ended (step 108). In other words, performance of normal fuel cut control is permitted. In this case, it is next judged whether or not the amount "spm" of PM accumulating on the PM filter 18 is equal to or more than a predetermined value "spm2" (step 110). This predetermined value "spm2" is a threshold value used to judge whether or not satisfactory regeneration can be continued while the PM filter 18 will not have excessively elevated temperature. Incidentally, the predetermined value "spm2" is set to a value smaller than the predetermined value "spm1".

If it is judged that the filter accumulating PM amount "spm" is greater than the predetermined value "spm2" in step 110, it is judged whether or not the temperature "tempflt" of the PM filter 18 is equal to or greater than the predetermined value "tempflt2" (step 112). The predetermined value "tempflt2" is a threshold value used to judge whether or not satisfactory regeneration can be continued while the PM filter 18 will not have excessively elevated temperature. Incidentally, the predetermined value "tempflt2" is set to a value smaller than the predetermined value "tempflt1".

Judgment may be made that the filter temperature "tempflt" is greater than the predetermined temperature "tempflt2" in step 112. That is to say, affirmative judgment may be made in both steps 110 and 112. In such a case, judgment can be made that the excessively elevated temperature of the PM filter 18 is a concern if a quantity of oxygen is carelessly fed to the PM filter 18 in the current conditions of the PM filter 18. In other words, the PM filter 18 is in the first stage. In this case, prior to the performance of the F/C prohibition control, slight-lean control is first exercised so that the atmosphere of the PM filter 18 may provide an air-fuel ratio slightly leaner than a stoichiometric air-fuel ratio.

The slight-lean control in step 114 controls the burning rate of PM (the regeneration rate of the PM filter) by controlling the leanness degree of the atmosphere of the PM filter 18 by use of the output of the sub O2 sensor 20. As described above, as the amount of oxygen fed to the PM filter 18 is increased, the burning rate of PM is increased, with the result that the burning temperature of PM is increased. Consequently, in step 114, the leanness degree of the atmosphere of the PM filter 18 is adjusted according to the current amount "spm" of PM accumulating on the PM filter 18 and to the filter temperature "tempflt" in a range where the PM filter 18 does not have excessively elevated temperature resulting from supply of oxygen to the PM filter 18 under the slight-lean control.

Alternatively, the leanness degree in the slight-lean control described above may be adjusted by making lean the control target air-fuel ratio of the A/F sensor 14 disposed upstream of the PM filter 18, or of the sub O2 sensor 20 disposed downstream of the PM filter 18.

On the other hand, if negative judgment is made in step 110 or 112, the slight-lean control mentioned above is ended (step 116). In other words, the air-fuel ratio control is returned to the normal air-fuel ratio feedback control to target the stoichiometric air-fuel ratio.

According to the routine shown in FIG. 2 and described above, the performance of the fuel cut is prohibited during deceleration if it is judged that the PM filter 18 is on the second stage. In the second stage, the amount "spm" of PM accumulating on the PM filter 18 is sufficiently large in excess of the predetermined value "spm1" and the temperature "tempflt" of the PM filter 18 is sufficiently high in excess of the predetermined value "tempflt1". Therefore, if the fuel cut is performed during deceleration, the PM filter 18 has abnormally high temperature in excess of the above-mentioned filter upper limit temperature. With the control described above, the prohibition of fuel cut can suppress the rapid increase of oxygen fed to the PM filter 18 on which PM sufficiently accumulates and which has high temperature. Thus, it is possible to prevent the PM filter 18 from having abnormally high temperature, thereby preferably preventing the PM filter 18 from being melted.

In addition, according to the routine shown in FIG. 2 and described above, before the prohibition of fuel cut, the slight-lean control is exercised to bring the atmosphere of the PM filter 18 into the lean atmosphere in the following case. In this case, the amount "spm" of PM accumulating on the PM filter 18 is relatively large in excess of the predetermined value "spm2" (<"spm1") and the temperature "tempflt" of the PM filter 18 is relatively high in excess of the predetermined value "tempflt2" (<"tempflt1"). Therefore, it can be judged that the PM filter 18 is on the first stage where the excessively elevated temperature of the PM filter 18 is a concern. In other words, according to the routine described above, any one of the fuel cut prohibition control during deceleration and the slight-lean control is selected according to the degree of excessively elevated temperature assumed with respect to the PM filter 18. According to the routine described above, after started once, the slight-lean control exercised to prevent the PM filter 18 having excessively elevated temperature is continuously exercised until it is judged in step 110 that the PM filter 18 will not have excessively elevated temperature.

With the slight-lean control described above, at the time when PM accumulates to such a level that the excessively elevated temperature of the PM filter 18 is a concern, the control of the PM burning rate (the PM regeneration rate) is exercised by adjusting the oxygen supply amount (the leanness degree) in accordance with the amount "spm" of PM accumulating on the PM filter 18 and with the temperature "tempflt" of the PM filter 18. This can burn and remove the PM accumulating on the PM filter 18 in a range where the PM burning temperature will not reach an abnormally high level. That is to say, the filter accumulating PM amount "spm" can be rapidly reduced to such an appropriate level that the excessively elevated temperature of the PM filter 18 is not concerned. In this way, it is possible to prevent the progress of PM accumulation on the PM filter 18 to such a level that melting of the PM filter 18 occurs due to abnormally high temperature resulting from execution of fuel cut.

With the slight-lean control described above, even if the fuel cut is to be performed during deceleration, it is possible to reduce the filter accumulating PM amount "spm" can be reduced to an appropriate level so that the temperature "tempflt" of the PM filter 18 will not exceed the upper limit temperature thereof. This can avoid the prohibition of fuel cut during deceleration as much as possible. In other words, it is possible to achieve a preferable balance between the prevention of excessively elevated temperature of the PM filter 18 and an improvement in fuel consumption resulting from ensuring time for performing the fuel cut.

In the present embodiment described above, at the time when the first stage is reached where the excessively elevated temperature of the PM filter 18 is a concern, the slight-lean control is exercised so that the atmosphere of the PM filter 18 may become the lean atmosphere. Consequently, the system provided with the internal combustion engine 10 basically performing the stoichiometric operation can satisfactorily prevent the occurrence of the excessively elevated temperature of the PM filter 18 (and thus, the melting of the PM filter 18) by maintaining the filter accumulating PM amount "spm" at an appropriate level free of the excessively elevated temperature. It is thus possible to facilitate the continuous regeneration of the PM trapped by the PM filter 18 without an adverse effect.

According to the processing of the routine described above, even in the case where the filter accumulating PM amount "spm" exceeds the predetermined value "spm1" where the performance of fuel cut should be prohibited, if the temperature "tempflt" of the PM filter 18 is between the predetermined value "tempflt1" and the predetermined value "tempflt2", the accumulating PM can be burned and removed by the slight-lean control based on the filter accumulating PM amount "spm".

In addition, the slight-lean control described above is exercised, with the result that lean gas is fed to also the upstream side three-way catalyst 16. For this reason, if the slight-lean control is continued for a long time, a NOx-purification capacity is liable to deteriorate. However, the slight-lean control of the present embodiment brings the atmosphere of the PM filter 18 into the slight-lean atmosphere by use of the output of the sub O2 sensor 20. With such control, the sensor provided for the sub feedback control described above for the upstream side three-way catalyst 16 is used to accurately control the oxygen concentration of the exhaust gas passing the PM filter 18. Thus, the slight-lean control can accurately be exercised while the deterioration in the NOx-purification capacity remains minimized.

Incidentally, in the first embodiment, which has been described above, the "filter OT judgment means" according to the first or third aspect of the present invention is implemented when the ECU 24 performs the processing of steps 102 and 104, or of steps 110 and 112. In addition, the "control means" according to the first aspect of the present invention is implemented when the ECU 24 performs the processing of step 114.

Further, the "fuel cut control means" according to the third aspect of the present invention is implemented when the ECU 24 controls the performance of fuel cut based on the predetermined establishment conditions during the deceleration of the internal combustion engine 10. In addition, the "fuel cut prohibition means" according to the third aspect of the present invention is implemented when the ECU 24 performs the processing of step 106.

Further, the "air-fuel ratio control means" according to the fourth or sixth aspect of the present invention is implemented when the ECU 24 performs the processing of steps 114 and 116.

Further, the "OT degree judgment means" according to the sixth aspect of the present invention is implemented when the ECU 24 performs the processing of steps 102, 104, 110, and 112. In addition, the "filter OT avoidance control selection means" according to the sixth aspect of the present invention is implemented when the ECU 24 performs a series of processing shown in FIG. 2.

Further, the upstream side three-way catalyst 16, the main linear A/F sensor 14, and the sub O2 sensor 20 correspond to the "a catalyst", the "an upstream side air-fuel ratio sensor", and the "a downstream side air-fuel ratio sensor", respectively.

The invention claimed is:

1. A control apparatus for an internal combustion engine that is provided in an exhaust passage with a particulate filter for trapping particulate matter contained in exhaust gas, and that performs stoichiometric burn operation at a stoichiometric air-fuel ratio, the control apparatus comprising an electronic control unit (ECU) including control logic configured to perform the following logic steps during deceleration:

(a) determine whether an amount of particulate matter (PM) on the PM filter is greater than a first predetermined PM amount, wherein if the amount of PM on the PM filter is greater than the first predetermined PM amount, the ECU performs step (b), else the ECU performs step (c);

(b) determine whether a temperature of the PM filter is greater than a first predetermined temperature, wherein if the temperature of the PM filter is greater than the first predetermined temperature, the ECU performs fuel cut prohibition control during deceleration and returns to step (a), else the ECU performs step (c);

(c) end fuel cut prohibition control and perform normal fuel cut control during deceleration, if the ECU was performing fuel cut prohibition control, or maintain slight-lean control, if the ECU was performing slight-lean control, or maintain normal fuel cut control, if the ECU was performing normal fuel cut control; and then (d) determine whether the amount of PM on the PM filter is greater than a second predetermined PM amount, the second predetermined PM amount being less than the first predetermined PM amount, wherein if the amount of PM on the PM filter is greater than the second predetermined PM amount, the ECU performs step (e), else the ECU performs step (f);

(e) determine whether the temperature of the PM filter is greater than a second predetermined temperature, the second predetermined temperature being less than the first predetermined temperature, wherein if the temperature of the PM filter is greater than the second predetermined temperature, the ECU performs slight-lean control during deceleration and returns to step (a), else the ECU performs step (f);

(f) end slight-lean control and perform normal fuel cut control during deceleration, if the ECU was performing slight-lean control, or maintain normal fuel cut control if the ECU was performing normal fuel cut control during deceleration;

wherein slight-lean control is where the air-fuel ratio of the exhaust gas is controlled so that an atmosphere of the particulate filter is slightly leaner than the stoichiometric air-fuel ratio.

2. The control apparatus for the internal combustion engine according to claim 1, further comprising:

a catalyst disposed in the exhaust passage capable of purifying the exhaust gas;

an upstream side air-fuel ratio sensor disposed in the exhaust passage upstream of the catalyst configured to obtain information on an air-fuel ratio of the exhaust gas discharged from a cylinder; and a downstream side air-fuel ratio sensor disposed in the exhaust passage downstream of the catalyst configured to obtain information on an air-fuel ratio of the exhaust gas discharged downstream of the catalyst, wherein:

the particulate filter is disposed in the exhaust passage upstream of the downstream side air-fuel ratio sensor; and when exercising the slight-lean control, the ECU controls the atmosphere of the particulate filter into the slight-lean atmosphere on the basis of an output of the downstream side air-fuel ratio sensor received by the ECU.

* * * * *